US005906212A

United States Patent [19]

Favre

[11] Patent Number: 5,906,212

[45] Date of Patent: May 25, 1999

[54] COMPACT

[75] Inventor: Bernard Favre, Chevilly Larue, France

[73] Assignee: LIR France, Chevilly Larue, France

[21] Appl. No.: 08/964,624

[22] Filed: Nov. 5, 1997

[30] Foreign Application Priority Data

| | | | |
|---|---|---|---|
| Nov. 5, 1996 | [FR] | France | 96 13446 |
| Jan. 16, 1997 | [FR] | France | 97 00409 |
| Mar. 18, 1997 | [FR] | France | 97 03252 |

[51] Int. Cl.[6] ..... A45D 33/24

[52] U.S. Cl. ..... 132/300

[58] Field of Search ..... 132/293, 294, 132/295, 296, 300, 301, 303, 305

[56] References Cited

U.S. PATENT DOCUMENTS

| | | | |
|---|---|---|---|
| 1,694,185 | 12/1928 | Leberman . | |
| 1,748,491 | 2/1930 | May . | |
| 1,930,532 | 10/1933 | Mitchell | 132/300 |
| 2,054,004 | 9/1936 | Sandberg | 132/293 |
| 2,466,295 | 4/1949 | Algier . | |
| 4,972,860 | 11/1990 | Yuhara et al. | 132/293 |
| 5,542,561 | 8/1996 | Slink et al. . | |

FOREIGN PATENT DOCUMENTS

| | | |
|---|---|---|
| 0 614 629 | 9/1994 | European Pat. Off. . |
| 8-38245 | 2/1996 | Japan . |
| 8-150016 | 6/1996 | Japan . |
| 8-154731 | 6/1996 | Japan . |
| 8-191712 | 7/1996 | Japan . |
| 8-238122 | 9/1996 | Japan . |
| 8-242936 | 9/1996 | Japan . |
| 8-242937 | 9/1996 | Japan . |

*Primary Examiner*—Todd E. Manahan
*Attorney, Agent, or Firm*—Young & Thompson

[57] ABSTRACT

A compact comprising a base (1) has a recess (3) for a dish (4) of makeup (5), an external cylindrical periphery, an intermediate plate (7) and a cover (2) articulated on the base (1) and is provided with an internal mirror (2'). The recess in the base (1) comprises an external cylindrical periphery provided with a plurality of screw ramps that are equally angularly spaced. The intermediate plate (7) has a recess in which is rotatably disposed a gripping disk (10) covering at least partially the intermediate plate (7), this gripping disk being provided with a cylindrical collar (11) provided internally with a plurality of screw ramps (12) arranged to coact with the screw ramps (6) provided on the external periphery of the recess (3), so as to grip the intermediate plate (7) against the base (1).

15 Claims, 2 Drawing Sheets

COMPACT

CROSS REFERENCE TO RELATED APPLICATIONS

This application corresponds to French application 96 13446 of Nov. 5, 1996, French application 97 00409 of Jan. 16, 1997, and French application 97 03252 of Mar. 18, 1997, the disclosures of which are incorporated herein by reference.

FIELD OF THE INVENTION

The present invention relates to a container, particularly a compact, of the type comprising a base comprising a recess for a pan of makeup, an intermediate plate and a cover articulated on said base and provided with an internal mirror.

BACKGROUND OF THE INVENTION

In a known case of this type (FR-A-2 581 849), the axis of articulation of the intermediate plate on the base is common to the axis of articulation of the cover, the makeup (or makeups) being carried by the intermediate plate, the base being adapted to contain an applicator such as a sponge or a powder puff, whilst the interior of the cover comprises a mirror. The use of such a case is impaired by the fact that the withdrawal of the sponge or the powder puff requires swinging of the intermediate plate. Moreover, if the base must be kept sealed, the seal must be carried out between the cover and the base, which is difficult to provide because of the presence of the intermediate plate between the cover and the base.

Thus, there are known cases in which the seal is obtained between the cover and the base, the case comprising an internal resilient cover ensuring the seal with an upper wall of a recess of the base (see EP-A-0 614 629). The cover comprises a rotatable ring, mounted fixed against translation in the case and having on its internal cylindrical surface portions of female screw threads spaced angularly, adapted to coact with male screw thread portions spaced regularly on the external cylindrical wall of the recess of the base. During rotation of the ring, the male and female screw thread portions coact to close in a sealed manner the case, which is opened by rotating the ring in the opposite direction.

There is also known from JP-A-08 238 122, a case whose base receives a makeup cartridge provided with a bottom and a cover coacting with each other by complementary screw-threaded portions. When the cartridge is mounted in the case, the cover of said cartridge is secured to the cover of the case and has a portion projecting from said cover of the case which, when it is rotated in one direction, permits opening the case and the cartridge and, when it is rotated in the opposite direction, permits sealed closing of the case.

The document JP-A-08 150016 provides a case in which a closure disk is mounted secured to the cover of the case and coacts with the cylindrical external wall of a recess in the base of the case such that, during rotation of the disk, the screw-threaded elements carried by the disk are operated and by the engagement with each other open or close the case.

In U.S. Pat. No. 5,542,561, the case comprises a base provided with a wall projecting upwardly delimiting a recess for a product and provided, on its external surface in the form of a cylinder of revolution, screw means coacting with complementary screw means provided on an internal cylindrical wall which is a figure of revolution, on the cover, said cover being provided in its base with a material suitable to ensure sealing against the upper surface of the recess of the base. The cover is articulated on the base of the case by means of a ring surrounding the external wall of said cover between means limiting the base and whose axial length is greater than its thickness, this ring permitting the emplacement and removal of the cover on and from the base by screwing.

In U.S. Pat. No. 2,466,295, the case has an articulation between the base and the cover of which one of the elements is mounted fixedly on the cover whilst the other element is mounted driveably in rotation on the upper surface of the base of the case.

Such structures do not permit providing an intermediate plate.

To solve the problems of sealing resulting from the use of makeup with volatile components, there has been proposed (see FR-A-2 576 496) the use of an internal cover pivoting or enclosed, ensuring solely the sealing of the base containing the makeup. Such a solution is cumbersome and its use is complicated.

There has also been proposed (FR-A-2 686 784) that the intermediate plate be an interchangeable platform that snaps into the base. Such a solution does not permit in a simple manner, using an applicator such as a sponge or a powder puff.

There has also been proposed a case (JP-A-08 242 937) in which sealing is ensured with the help of an intermediate plate articulated on the base in a manner perpendicular to the articulation of the cover of the case.

The base of said case comprises a recess in which is received a dish of makeup and which has on its periphery a rotatable frame having snap-in projections. The intermediate plate has projecting tongues on its surface turned toward the base of the case, said tongues extending along the rotatable frame when the plate rests on the base. These tongues are provided with snap-in projections adapted to coact with the complementary projections of the rotatable frame when the latter is rotated. The cover also comprises a snap-in nose coacting with a projection of the rotatable frame.

Thus, the rotatable frame permits locking the intermediate plate disposed on the base and the closing of the cover by simple rotation of said frame to cause coaction between the snap-in projections with the projections of the tongues of the plate and the snap-in nose of the cover.

There is provided a spring in the device for rotating the rotatable frame, to open the case such that it is difficult to obtain a differentiated opening of the case and then an unlocking of the plate. Because of this, when desired, in the case of a case provided with a mirror, to have access only to said mirror without using the makeup, the unlocking of the intermediate plate also takes place, thereby destroying the seal itself in a case in which this is not useful.

SUMMARY OF THE INVENTION

The present invention seeks as a result to provide a new compact of simple and economical construction, easy to use and comfortable, and which moreover is easily adapted to be sealed as to the makeup compartment in a manner independent of the opening system of the case itself.

To this end, the case according to the invention is characterized by the fact that the recess in the base comprises an external cylindrical periphery of revolution provided with a plurality of screw ramps angularly spaced at a constant interval and the intermediate plate has a recess in which is disposed rotatably a locking disk covering at least partially the intermediate plate, said locking disk being provided with a cylindrical collar of revolution provided internally with a plurality of screw ramps arranged to coact with screw ramps of the base so as to grip the intermediate plate on the base.

After having opened the cover of the case, it suffices to unscrew the gripping disk to free the intermediate plate and have access to the makeup.

Preferably, the gripping disk is disposed in the recess of the intermediate plate without axial play. There is thus obtained a gripping of the intermediate plate disposed on the base by simple engagement of the screw ramps during a short rotation of the gripping disk. Thus, the gripping disk being disposed rotatably in the recess of the intermediate plate but without axial play, as soon as the screw ramps of the gripping disk coact with the screw ramps of the recess, there takes place an immediate gripping of the intermediate plate on the base.

The intermediate plate may be simply disposed in the base but preferably the intermediate plate pivots about an axis on the base orthogonal to the axis of pivoting of the cover. The intermediate plate, after pivoting, can thus be released without impeding the makeup operation which takes place by use together of the case in one hand and the applicator in the other hand.

Preferably, the gripping disk comprises, on its face opposite the cylindrical collar of revolution, a recess for an applicator.

When it is necessary that the makeup be kept in a sealed chamber between periods of use, which is the case for volatile makeup formulae such as those based on water or silicone, the invention provides that a sealing joint is disposed at least in the internal region of the gripping disk adjacent the cylindrical collar of revolution. This sealed joint is, during screwing of the gripping disk, compressed between the edge of the recess of the makeup dish, thereby ensuring sealed closure of this recess.

Preferably, the gripping disk comprises an index for opening and closing relative to the base of the case so as to see whether the gripping disk is in open or closed position. Thus, it is possible to identify effectively the position of the gripping disk itself to guarantee good closure, and, in particular, to ensure a good seal.

According to another embodiment of the invention, the base of the case is constituted by two separate pieces such as a ring on which is articulated the cover and a cup forming a base and a peripheral cylindrical wall of revolution provided with short screw ramps of constant angular spacing and having snap-in means coacting with complementary snap-in means provided in the ring.

When the cup is mounted in the ring, said cup forms the recess in the base receiving the product and its screw ramps can coact with the screw ramps with which the interior of the cylindrical collar of revolution is provided, on the gripping disk disposed in the intermediate plate.

The cup forming the recess of the base can receive a makeup dish or preferably it is made of a material adapted to preserve makeup which can thus be poured directly into the interior of the recess defined by said cup.

The ring is made preferably of a material similar or identical to the material constituting the cover.

Preferably, to make the case reloadable, the snap-in means are reversible and, once the product contained in the cup is totally used, it is possible to withdraw said cup and to emplace in the ring a new cup to reload it.

In this case, and so as to preserve the contained product, the cup, as an independent reloaded element of the case, is provided with a cover provided with a sealing joint suitable to preserve the product therein and which is taken off during emplacement in the case.

This embodiment permits obtaining a case that is easily reloadable.

BRIEF DESCRIPTION OF THE DRAWINGS

Other characteristics and advantages of the present invention will become apparent from the following description of examples of preferred embodiments, with reference to the accompanying drawings, in which.

DESCRIPTION OF THE PREFERRED EMBODIMENTS

Figure 1:
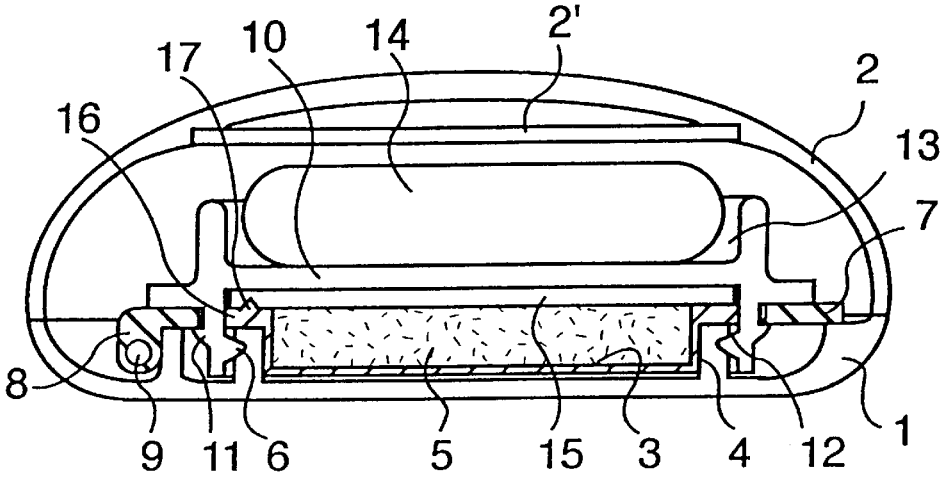
FIG. 1 is a schematic transverse cross-sectional view of the case, parallel to the axis of rotation of the cover on the base, according to a first preferred embodiment.
Figure 2:
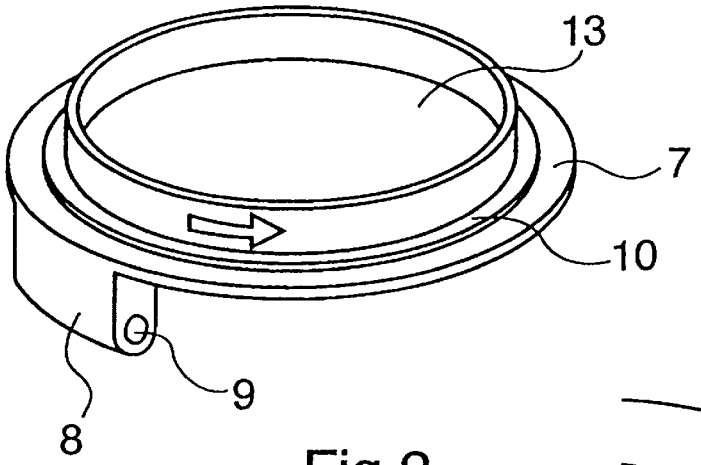
FIG. 2 is a schematic perspective view of the intermediate plate and of the gripping disk.
Figure 3:
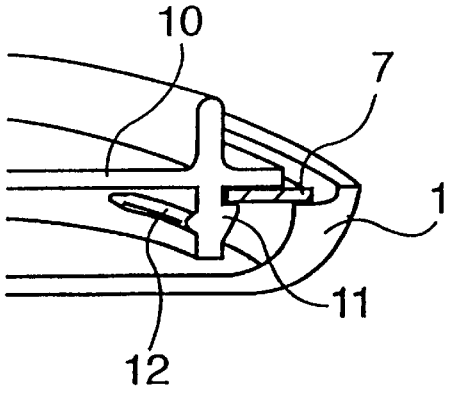
FIG. 3 is a schematic cross-sectional perspective view of the periphery of the base, with the intermediate plate and the gripping disk.

The case shown in the drawings comprises a base 1 and a cover 2 mounted pivotally on the base 1 about an axle (not shown). The cover 2 comprises an internal mirror 2', the base 1 comprises a recess 3 for a dish 4 containing makeup 5. The external periphery of the recess 3 is provided with a plurality of short screw ramps 6 at constant angular spacing.

The case comprises moreover an intermediate plate 7 of annular shape provided with a tongue 8 for articulation about an axis 9 on base 1 orthogonal to the axis of articulation of the cover 2.

A gripping disk 10, covering at least partially the intermediate plate 7, comprises a cylindrical revolution collar 11 and rotates in a recess of the intermediate plate 7, preferably without axial play, said collar being provided internally with a plurality of short screw ramps 12 disposed so as to coact with the screw ramps 6 of the base 1, so as to grip the intermediate plate 7 on the base 1. A surface of the gripping disk 10 is provided with a sealing joint 15 coacting with the edge of the recess 3 in the base 1.

In the embodiment shown in FIG. 1, the dish 4, which can be of metal, such as aluminum or lacquered steel, or of a synthetic material, comprises a peripheral return 16 provided with an annular flange 17. So as to make the case rechargeable, the dish 4 can be mounted in a removable snap-in manner in the base 1.

When the cover 2 is open, a short rotation of the gripping disk 10 disengages the ramps 12 from the ramps 6 of the base 1. The intermediate plate 7 can then pivot about the axis 9, with the gripping disk 10, and the user can then apply makeup with the applicator 14 which has first been withdrawn from a recess 13 whilst looking in the mirror 2'. After use, the intermediate plate 7 is swung, with the disk 10, into closed position, then the plate 7 is gripped against the base 1 by screwing the gripping disk 10, which compresses the sealing joint 15 against the edge of the recess 3 of the base, more particularly against the return 16 of the dish 4. The flange 17 permits ensuring sealing without excessive compression of the joint 15 along a large surface.

The sealing joint 15 can be of quite varied shape and construction. It can be a toric joint molded of an elastically deformable material. As a modification, there could be used a disk or a ring, for example a composite of aluminum and polyethylene foam.

The case according to the invention offers, with a simple and economical structure, a very handy useability. Thus, the gripping disk being mounted rotatably in the recess of the plate 7, preferably without axial play, a short rotation of the disk permits either the gripping of the plate or its ungripping. Moreover, when it comprises the sealing joint 15, it provides sealing of a cover of a usual container of conventional use of a makeup case.

Figure 4:
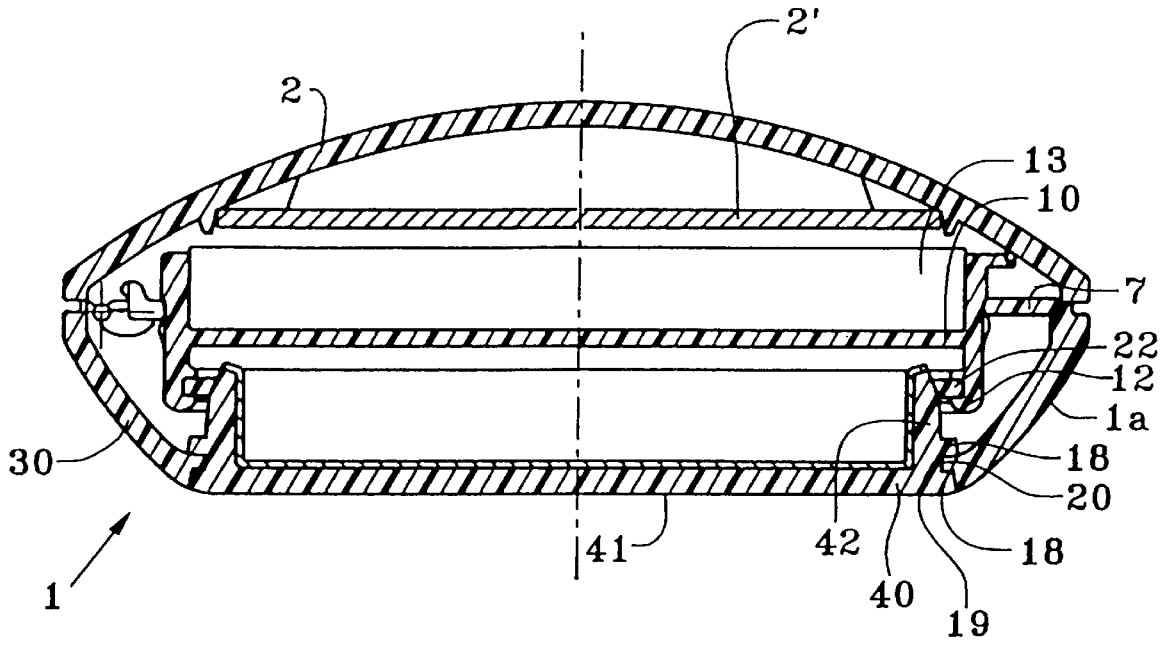
FIG. 4 is a schematic cross-sectional view of the case according to a second embodiment.

In the embodiment shown in FIG. 4, the case encloses the same elements as those described above except for the base 1 which is constituted, in this example, by two separate pieces 30 and 40.

The first piece is in the form of a ring 30 on which the cover 2 is pivotally mounted about an axis (not shown).

The second piece constituting the base 1 is a cup 40 provided with a base 41 and with a peripheral wall which is a cylinder of revolution 42, having snap-in means coacting with complementary snap-in means provided on the internal wall of the ring 30.

The snap-in means of the cup 40 can be constituted by two peripheral grooves 18 provided on the external surface of the peripheral wall 42 of the cup 40 and defining a throat 19 within which snaps a peripheral rib 20 provided correspondingly on the internal surface of the ring 30.

The snap-in means can be arranged to permit an emplacement of the cup 40 from the interior of the case or even from the exterior of said case.

The cup 40 has, on the external surface of its peripheral wall 42, short screw ramps 22 adapted to coact with screw ramps 12 of the cylindrical collar of revolution 11 of the gripping disk 10 covering at least partially the intermediate plate 7.

When the cup 40 is emplaced in the ring 30 by snapping in, it is appropriate to position the screw ramps 22 of said cup 40 correctly relative to the ramps 12 of the collar 11.

To this end, the cup 40 and the ring 30 having respectively a reference mark, the positioning in coincidence of said reference marks during emplacement of the cup 40 in the ring 30, permits good orientation of said cup 40 in the case.

According to another embodiment, the snap-in means of the cup 40 and the complementary means provided on the ring 30 are positioned with a constant angular spacing adapted to permit a correct emplacement of the screw ramps 22 of the cup 40 relative to those of the collar 11.

Makeup is positioned in the cup 40 by means of a dish 4 or else it can be directly molded into said cup 40 when the latter is constituted of a suitable material.

In this last case, to make the case reloadable, the snap-in means are preferably reversible and, during all the time there is makeup to be used, it is possible to reload the case by withdrawing the cup 40 empty and emplacing a new cup 40, as in the case of a dish for the other embodiment.

What is claimed is:

1. In a compact (1) comprising a base having a recess (3) for a dish (4) of makeup (5), having an external cylindrical periphery, an intermediate plate (7) and a cover (2) articulated on said base (1) and provided with an internal mirror (2'); the improvement wherein the recess of the base (1) has an external cylindrical periphery provided with a plurality of regularly angularly spaced screw ramps and the intermediate plate (7) has a recess in which a gripping disk (10) is rotatably disposed covering at least partially the intermediate plate (7), said gripping disk being provided with a cylindrical collar (11) provided internally with a plurality of screw ramps (12) arranged to coact with the screw ramps (6) provided on the external cylindrical periphery of the recess (3) so as to grip the intermediate plate (7) on the base (1).

2. A compact according to claim 1, wherein the gripping disk (10) is disposed rotatably in the recess of the intermediate plate (7) without axial play.

3. A compact according to claim 1, wherein the dish (4) is of aluminum, lacquered steel or a synthetic material.

4. A compact according to claim 1, wherein the intermediate plate (7) pivots about an axis (9) on the base (1) which is orthogonal to the axis of pivoting of the cover (2).

5. A compact according to claim 1, wherein the gripping disk (10) comprises on its face opposite the cylindrical collar (11), a recess (13) for an applicator (14).

6. A compact according to claim 1, wherein the gripping disk (10) comprises an index for opening relative to the base (1) of the compact so as to visualize whether the gripping disk (10) is in open or closed position.

7. A compact according to claim 1, wherein a sealing joint (15) is disposed at least within an internal region of the gripping disk (10) adjacent the cylindrical collar (11).

8. A compact according to claim 7, wherein said sealing joint (15) is a toric joint.

9. A compact according to claim 7, wherein said sealing joint (15) is a disk or ring.

10. A compact according to claim 9, wherein said sealing joint is a composite of aluminum and polyethylene foam.

11. A compact according to claim 1, wherein the dish (4) comprises a peripheral return (16) provided with an annular flange (17).

12. A compact comprising a base having an external cylindrical periphery, an intermediate plate and a cover articulated on the base and provided with an internal mirror, said base being constituted by two separate pieces comprising a ring on which the cover is articulated, and a cup defining a recess for makeup, and comprising a bottom and a cylindrical peripheral wall provided with short screw ramps and having snap-in means coacting with complementary snap-in means provided in the ring, the intermediate plate having a recess in which a gripping disk is rotatably disposed covering at least partially the intermediate plate, said gripping disk being provided with a cylindrical collar provided internally with a plurality of screw ramps arranged to coact with the short screw ramps of the cylindrical peripheral wall, so as to grip the intermediate plate against the base.

13. A compact according to claim 12, wherein the cup (40) is constituted of a material adapted to preserve makeup, the makeup being poured directly within the recess defined by said cup (40).

14. A compact according to claim 12, wherein the cup (40) and the ring (30) each have a reference mark, the placing in coincidence of said reference marks during the emplacement of the cup (40) in the ring (30) permitting good orientation of said cup (40) in the compact.

15. A compact according to claim 12, wherein the snap-in means of the cup (40) and the complementary snap-in means provided on the ring (30) are positioned at a constant angular spacing suitable to permit correct emplacement of the screw ramps (22) of the cup (40) relative to those of the collar (11).

* * * * *